US005220714A

United States Patent [19]

Sanno

[11] Patent Number: 5,220,714

[45] Date of Patent: Jun. 22, 1993

[54] APPARATUS FOR REMOVING RESIDUAL ROVING FROM ROVING BOBBIN

[75] Inventor: Hiroaki Sanno, Ishikawa, Japan

[73] Assignee: Kabushiki Kaisha Murao and Company, Kanazawa, Japan

[21] Appl. No.: 672,081

[22] Filed: Mar. 19, 1991

[51] Int. Cl.[5] ..... B65H 73/00

[52] U.S. Cl. ..... 28/294; 28/292

[58] Field of Search ..... 28/294, 293, 292, 297, 28/298

[56] References Cited

U.S. PATENT DOCUMENTS

| | | | |
|---|---|---|---|
| 1,711,429 | 4/1929 | Senn | 28/292 |
| 3,289,266 | 12/1966 | Brown et al. | 28/294 |
| 3,528,150 | 9/1970 | Schmid | 28/294 |
| 3,803,673 | 4/1974 | Kupper | 28/294 X |
| 4,267,983 | 5/1981 | Leu | 28/294 X |
| 4,765,043 | 8/1988 | Yamashita | 28/294 |
| 4,793,036 | 12/1988 | Nakayama | 28/294 |

FOREIGN PATENT DOCUMENTS

| | | |
|---|---|---|
| 0401827 | 12/1990 | European Pat. Off. . |
| 0401828 | 12/1990 | European Pat. Off. . |
| 60-94628 | 5/1985 | Japan . |
| 226931 | 1/1990 | Japan . |

*Primary Examiner*—Clifford D. Crowder
*Assistant Examiner*—Bibhu Mohanty
*Attorney, Agent, or Firm*—Oblon, Spivak, McClelland, Maier & Neustadt

[57] ABSTRACT

An apparatus for removing a residual roving attached to a roving bobbin to obtain a blank bobbin, including a rotary driving device for rotating the roving bobbin alternately in a forward direction and a reverse direction, and a device for completely removing the residual roving strongly attached to a roving wind assisting cloth provided on the blank bobbin. A suction nozzle for sucking the roving bobbin is moved to a position where a tip of the suction nozzle comes close to the roving wind assisting cloth, so that the residual roving strongly attached to the cloth can be completely removed by the suction nozzle as rotating the roving bobbin.

2 Claims, 4 Drawing Sheets

APPARATUS FOR REMOVING RESIDUAL ROVING FROM ROVING BOBBIN

BACKGROUND OF THE INVENTION

The present invention relates to an apparatus for removing a residual roving from a blank bobbin to be conveyed after it is taken out of a creel portion of a fine spinning frame or a roving frame in a spinning mill, and more particularly to such an apparatus having means for completely removing the residual roving also attached to a roving wind assisting member provided on the bobbin.

Various types of means for removing a residual roving left on a roving bobbin are known. In these known types, a suction nozzle is widely utilized to remove the residual roving at a high speed and thereafter untwist the roving at once. Further, there has been conventionally designed an apparatus for automating such a residual roving suction removing operation. Such an automatic removing apparatus has been conventionally developed and proposed by the Japanese Patent Application No. 1-147514. In the residual roving removing apparatus by utilizing the suction nozzle, the roving bobbin is rotated at a fixed position, and a nozzle tip of the suction nozzle is advanced to the roving bobbin. Then, the suction nozzle is raised and lowered to search a thread terminal of the residual roving on the bobbin as sucking the same. Then, the suction nozzle is retracted from the roving bobbin to a vertical position corresponding to a substantially central vertical position of the roving bobbin, and the roving bobbin is rotated at a high speed to remove the residual roving.

The roving bobbin is often provided with a roving winding assisting member alternatively called a roving wind assisting member for reliably retaining a starting end of the roving at the time of winding the roving in the roving frame. It is known that such an assisting member is so constructed as to include a groove for nipping the roving or include an adhesive tape for bonding the roving. However, most of the assisting member is formed from an assisting cloth 16 such as a flocked cloth and a raised cloth as shown in FIG. 8 (side view of a bobbin 1). The assisting cloth 16 is mounted in a circumferential recess formed on the bobbin 1 at a lower portion thereof. As shown in FIG. 9 (cross section taken along an arrow in FIG. 8), a plurality of projections of the assisting cloth 16 are inclined in a roving winding direction of the bobbin 1 as shown by an arrow in FIG. 9, so as to easily catch the starting end of the roving. Alternatively, the projections are erected radially from a base fabric. Thus, the assisting cloth 16 is advantageous for the roving winding operation.

However, in removing the residual roving from the bobbin, there is a problem such that the starting end tends to be strongly attached to the assisting cloth 16, causing incompleteness of the removal of the residual roving.

SUMMARY OF THE INVENTION

It is accordingly an object of the present invention to provide a residual roving removing apparatus which can reliably remove the residual roving strongly attached to the assisting member as well as the residual roving wound on the other portion of the roving bobbin.

According to the present invention, there is provided an apparatus for removing a residual roving from a roving bobbin having a roving wind assisting the member for assisting the start of a winding of a roving around a blank bobbin, comprising means for rotating said roving bobbin in forward and reverse directions; a suction nozzle for sucking said residual roving from said roving bobbin; means for vertically moving said suction nozzle along said roving bobbin; means for horizontally moving said suction nozzle so as to advance and retract the same toward and away from said roving bobbin; and means for positioning a tip of said suction nozzle at a vertical position corresponding to a height of said roving wind assisting member of said roving bobbin and a horizontal position close to said roving wind assisting member.

With this construction, the suction nozzle is operated to suck and remove the residual roving as the bobbin rotates at a high speed with the nozzle maintained at a retracted position corresponding to a substantially central vertical position of the roving bobbin. After the end of such a suction operation, the suction nozzle is vertically moved to a position corresponding to a vertical position of the assisting member, and is then advanced to the assisting member in such a manner that the nozzle tip of the suction nozzle comes close to the assisting member, while the roving bobbin is rotated forwardly and reversely, so as to suck the starting end of the residual roving attached to the assisting member.

Other objects and features of the invention will be more fully understood from the following detailed description and appended claims when taken with the accompanying drawings.

DETAILED DESCRIPTION OF THE PREFERRED EMBODIMENTS

Figure 1:
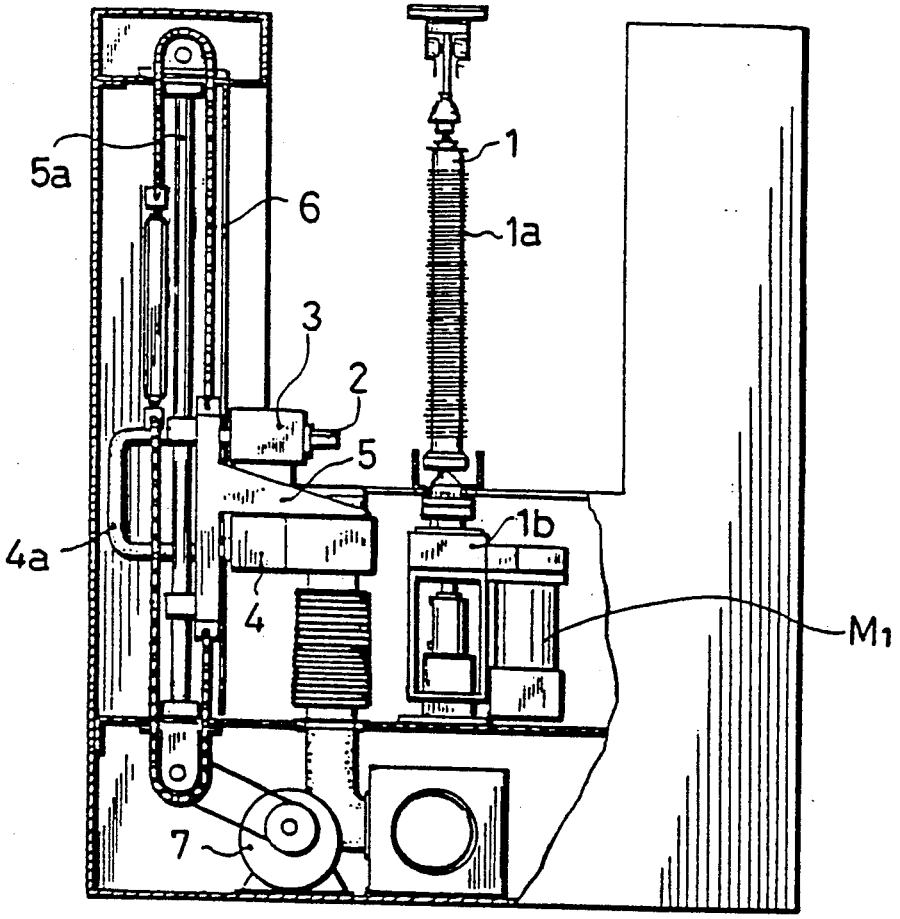
FIG. 1 is a partially cut-away side view of the residual roving removing apparatus according to a preferred embodiment of the present invention.

There will now be described a preferred embodiment of the present invention with reference to the drawings. It should be appreciated that the preferred embodiment shown in the drawings is merely illustrative and that the present invention may be similarly applied to any other residual roving suction removing apparatuses. FIG. 1 shows the residual roving removing apparatus of the preferred embodiment. The apparatus is fixedly disposed at a part of a blank bobbin carrier line. A plurality of roving bobbins 1 having residual rovings 1*a* as carried by the bobbin carrier line are once stopped in the residual roving removing apparatus. A rotary driving device 1*b* is located just below the roving bobbins 1. A part of the rotary driving device 1*b* is raised to engage the roving bobbins 1 and thereby rotate the same in an unwinding direction of the residual rovings 1*a*. The rotary driving device 1*b* includes a control motor M1 for rotating the bobbins 1 forwardly and reversely and varying a rotational speed of the bobbins 1.

A plurality of residual roving suction nozzles 2 are retained to an elongated retainer box 3 which can be moved vertically and horizontally. The suction nozzles 2 project from the retainer box 3 toward the roving bobbins 1. The retainer box 3 is horizontally slidably mounted on a duct 4 which can be substantially vertically moved, so as to be advanced toward and retracted from the roving bobbins 1. The duct 4 is fixed at its side portions under a pair of lifting members 5. The lifting members 5 are vertically slidably supported to a pair of guide posts 5*a* (one of which is shown) fixed to a frame. Each lifting member 5 is connected at its upper and lower ends to a pair of upper and lower chains 6 which are wrapped around a pair of upper and lower sprocket wheels. The lower sprocket wheel is rotated forwardly and reversely by a driving motor 7. Accordingly, the lifting member 5 is raised and lowered through the sprocket wheels and the chains 6. The raising and lowering operations of the lifting member 5 by the driving motor 7 is controlled by a control device (not shown), and a lift stroke of the lifting member 5 is limited by a limit switch (not shown). According to the operation of the limit switch, the stoppage and the rotational direction of the driving motor 7 is controlled by the control device. Further, each suction nozzle 2 is adapted to be stopped at a vertical position of the roving wind assisting cloth 16 provided on the bobbin 1 according to the operation of a position detector provided in a moving stroke of the lifting member 5 or a locus of movement of the chains 4.

Figure 2:
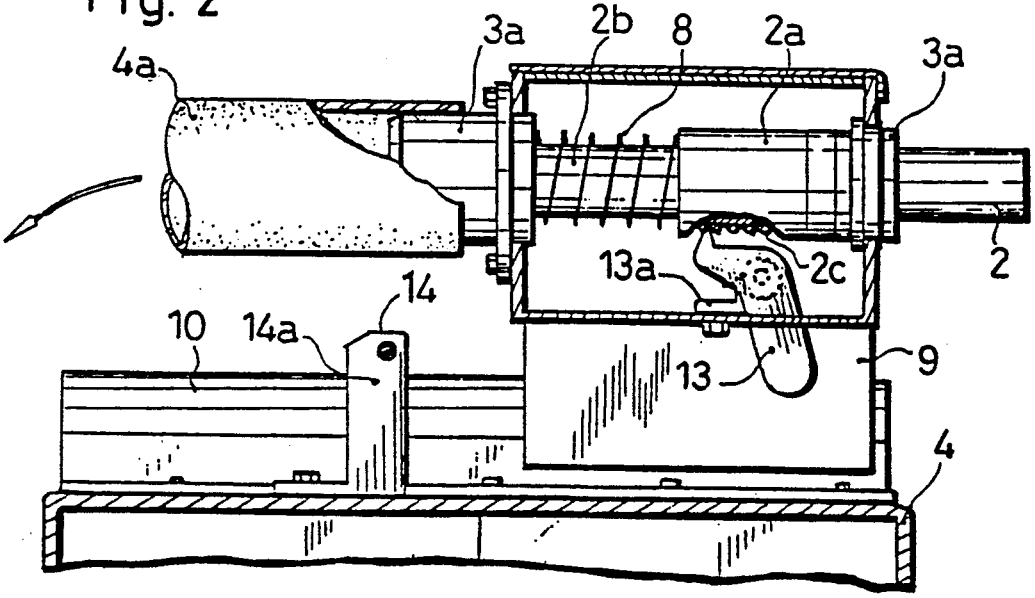
FIG. 2 is an enlarged vertical sectional view of an essential part of FIG. 1.
Figure 3:
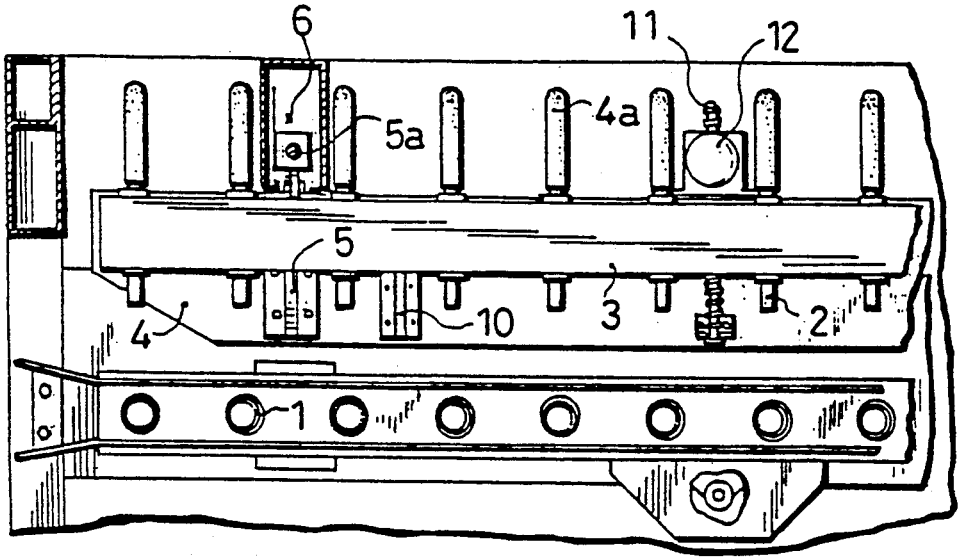
FIG. 3 is a plan view of a part of FIG. 1.

As shown in FIG. 2 (partially cut-away enlarged view of a part of FIG. 1), a pair of sliders 9 are fixedly mounted on a lower surface of the retainer box 3 at opposite side positions thereof. The sliders 9 are slidably supported to a pair of guide rails 10 fixedly mounted on an upper surface of the duct 4 in such a manner as to be movable horizontally. As shown in FIG. 3 (plan view of a part of FIG. 1), a screw shaft 11 is rotatably supported to the upper surface of the duct 4, and a drive control motor 12 is mounted on a rear surface of the retainer box 3 so as to rotate the screw shaft 11. Accordingly, when the control motor 12 is rotated forwardly and reversely, the retainer box 3 is moved horizontally and is guided by the guide rails 10. A horizontal movable range of the retainer box 3 is limited between a retract limit position and an advance limit position by a position sensor (not shown) provided on the duct 4.

Figure 4:
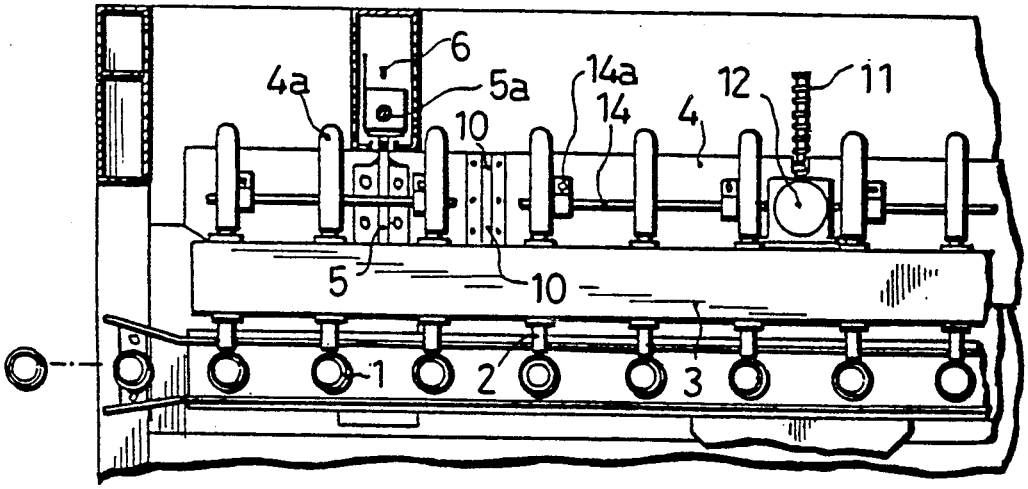
FIG. 4 is a view similar to FIG. 3, showing the advanced condition of the suction nozzle device.

Each suction nozzle 2 retained to the retainer box 3 has a nozzle tip projecting toward the corresponding bobbin 1. In an advanced condition of the retainer box 3 as shown in FIG. 4, the nozzle tip of each nozzle 2 is disposed close to the bobbin 1.

Figure 6:
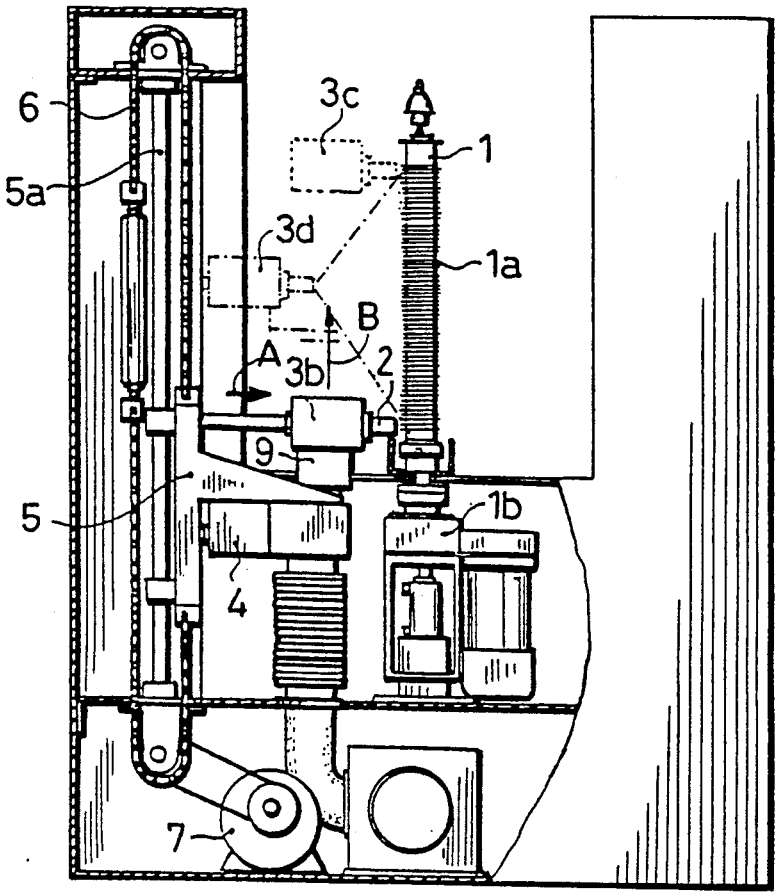
FIG. 6 is a view similar to FIG. 1, showing the operation of the present invention.
Figure 7A:
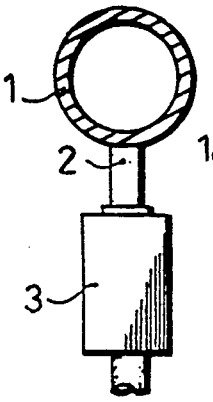
FIGS. 7A to 7D are views illustrating the suction operation by the suction nozzle.
Figure 7B:
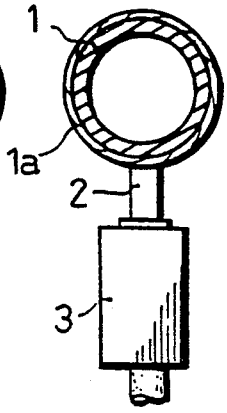
Figure 7C:
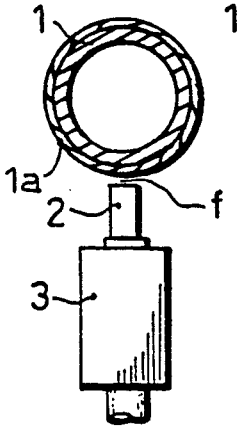
Figure 7D:
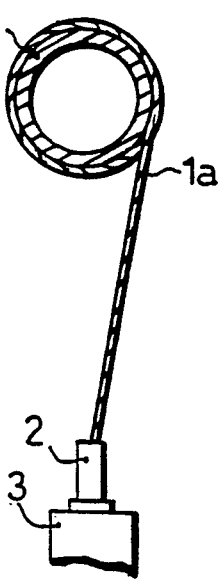
Figure 8:
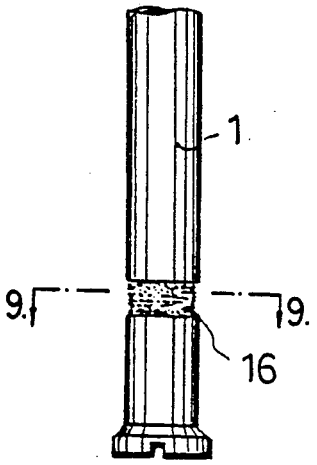
FIG. 8 is a side view of a part of the roving bobbin.
Figure 9:
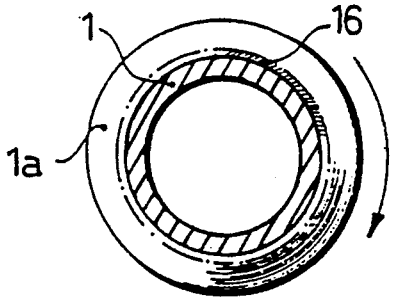
FIG. 9 is a cross section taken along the arrow in FIG. 8.

At starting of the suction by the suction nozzle 2, a terminal of the residual roving on the bobbin 1 is first searched as the suction operation continues. That is, as shown in FIG. 6 (showing an operative condition of FIG. 1), a part of the rotary driving device 1*b* is raised to engage a lower end of each bobbin 1 stopped after conveyed. Then, the rotary driving device 1*b* is operated to rotate the bobbins 1 at a low speed. On the other hand, the lifting members 5 are moved until each nozzle 2 comes to a lower-most position of the residue roving 1*a* on the bobbin 1. Then, the retainer box 3 is advance to a position 3*b* in a direction as shown by an arrow A, and the lifting member 5 is raised to lift the retainer box 3 to an upper-most position 3*c* of the residual roving on the bobbin 1 in a direction as shown by an arrow B. During this lifting operation of the nozzle 2, terminal of the residual roving 1*a* is searched as being sucked by the nozzle 2. Then, the retainer box 3 is retracted to move the nozzle 2 to a substantially intermediate vertical position 3*d* between the lower-most position 3*b* and the upper-most position 3*c*. At this intermediate vertical position 3*d*, the residual roving is sucked by the nozzle 2 as the bobbin 1 rotates at a high speed. In carrying out such operation for searching and sucking a thread terminal, it is necessary to maintain a suitable gap between the tip of the suction nozzle 2 and a surface of a layer of the residual roving on the bobbin 1. That is, if the tip of the suction nozzle 2 is in contact with the residual roving 1*a* as shown in FIG. 7(B), a suction air flow at the tip of the suction nozzle 2 cannot be formed, and the search and suction of the thread terminal cannot be therefore effected. Additionally, the layer of the residual roving 1*a* is disordered by the contact with the tip of the suction nozzle 2 to cause a difficulty of continuous suction and hinder the rotation of the bobbin 1. For this reason, it is necessary to maintain a given gap f between the tip of the suction nozzle 2 and the surface of the layer of the residual roving 1*a* as shown in FIG. 7(C). While this gap f depends on an amount and a velocity of the suction air flow or a kind of the roving, it is normally set to 5–10 mm. As shown in FIG. 7(D), the suction nozzle 2 having searched the thread terminal while sucking the same is retracted together with the retainer box 3, and is then lowered to the substantially intermediate vertical position of the bobbin 1. At this position, all the bobbins 1 are rotated at a high speed in the unwinding direction to thereby suck the residual rovings 1*a* into the suction nozzles 2.

Referring to FIG. 2, the suction nozzle 2 slidably mounted on the retainer box 3 constructed of a small-diameter tip portion, a large-diameter boss portion 2*a* and a small-diameter support portion 2*b* connected together. A pair of retainer rings 3*a* are fixed to front and rear walls of the retainer box 3, and the tip portion and the support portion 2*b* are slidably inserted through the retainer rings 3*a*. A coil spring 8 is provided around the support portion 2*b* to normally bias the suction nozzle 2 and outwardly project the tip portion from the retainer box 3. The coil spring 8 has a relatively small spring force. The boss portion 2*a* is formed at its lower portion with an axial groove having a bottom surface. The bottom surface of the axial groove is formed with a sawtoothed portion 2*c* engaging a ratchet 13. The ratchet 13 is pivotably supported to a bracket 13*a* fixed on an inner bottom surface of the retainer box 3, and a torsion spring (not shown) is interposed between the ratchet 13 and the bracket 13*a* to normally bias the ratchet 13 in a clockwise direction as viewed in FIG. 2 and thereby engage the sawtoothed portion 2*c* of the nozzle 2. Accordingly, when the tip of the nozzle 2 is urged inwardly (leftwardly in FIG. 2) against the biasing force of the coil spring 8 and is slid relative to the retainer box 3, the sawtoothed portion 2c is allowed to slide relative to the ratchet 13. However, when the retraction of the nozzle 2 is stopped, the ratchet 13 comes into engagement with the sawtoothed portion 2c again, and is latched at the retracted position under the compressed condition of the coil spring 8. Thereafter, when the retainer box 3 is retracted together with the nozzle 2 to a predetermined position, a lower portion of the ratchet 13 projecting downwardly from the retainer box 3 comes into abutment against a release means which will be hereinafter described, and is rotated in a counterclockwise direction as viewed in FIG. 2 to thereby release the engagement of the ratchet 13 with the sawtoothed portion 2c. As a result, the nozzle 2 is urged frontwardly by the coil spring 8 to restore the original projecting condition. In this manner, such an engagement releasing operation is automatically effected when the retainer box 3 is retracted to the predetermined position. As shown in FIGS. 2 and 4, the release means is constructed of a release bar 14 mounted through a plurality of brackets 14a on the upper surface of the duct 4, so that when the retainer box 3 is retracted to bring the lower portion of the ratchet 13 into abutment against the release bar 14, the ratchet 13 is rotated to disengage from the sawtoothed portion 2c of the nozzle 2. In searching the thread terminal of the residual roving with the gap f maintained as shown in FIG. 7(C), an advance limit position of the retainer box 3 is set in such a manner that the tip of the nozzle 2 comes to contact with an outer circumference of the bare bobbin as shown in FIG. 7(A). This advance limit position is detected by a position sensor or a limit switch provided on the retainer box 3, and the drive control motor 12 is adapted to be stopped according to the operation of the position sensor or the limit switch. Accordingly, when the tip of the nozzle 2 comes to contact with the surface of the layer of the residual roving 1a, the nozzle 2 is retracted by an amount corresponding to a thickness of the layer of the residual roving 1a with the retainer box 3 maintained at the advance limit position, and the nozzle 2 is latched to the retainer box 3 by the ratchet 13. Then, the retainer box 3 is retracted by the predetermined amount (the gap f of 5–10 mm), and is then raised by lifting the lifting member 5 with the gap f maintained, thus searching and sucking the thread terminal.

Figure 5:
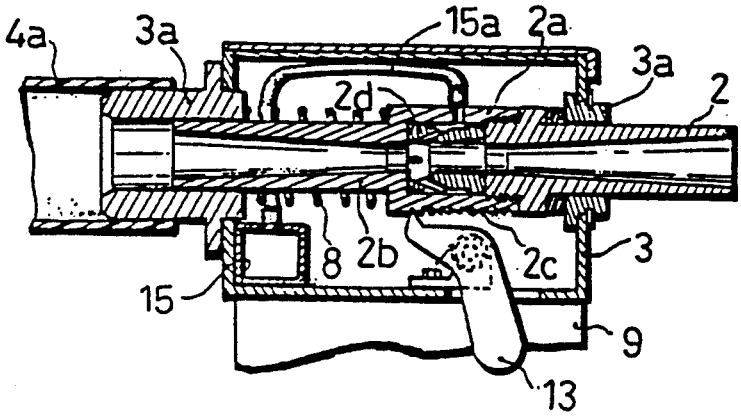
FIG. 5 is a vertical sectional view of the suction nozzle according to another preferred embodiment of the present invention.

In this preferred embodiment, a suction hose 4a is connected at its one end to the duct 4, and the other end of the suction hose 4a is connected to each suction nozzle 2 as shown in FIG. 2, so that the suction air flow can be formed by a reduced pressure applied through the suction hose 4a to the suction nozzle 2. As a modification of the suction nozzle 2, there is shown another preferred embodiment in FIG. 5 (vertical sectional view). Referring to FIG. 5, a pressure air is supplied to a part of the suction nozzle 2 so as to form a suction air flow at the tip of the nozzle 2. That is, a pressure air duct 15 is provided in the retainer box 3, and is connected through a flexible pipe 15a to the boss portion 2c of the suction nozzle 2. A cylindrical member 2d is installed in the boss portion 2c with an annular space defined therebetween and communicated with the flexible pipe 15a. The cylindrical member 2d is formed with a plurality of air injection holes communicating the annular space to an axial hollow portion of the cylindrical member 2d. The air injection holes are inclined axially and radially with respect to an axis of the cylindrical member 2d. Accordingly, an air flow injected from the air injection holes is swirled, and this injected air flow generates a suction air flow at the tip of the suction nozzle 2. According to this preferred embodiment, the suction air flow can be simultaneously formed in the plural suction nozzles, and the suction device can be made compact since a pressure air is utilized. Moreover, since the swirled air flow is generated in the suction nozzle 2, the residual roving after sucked from the tip of the nozzle 2 can be untwisted at once. In this case, the duct 4 is employed as an air duct containing the untwisted roving. Although the plural suction nozzles 2 are mounted to the retainer box 3 in the preferred embodiment, a single suction nozzle may be mounted to a compact retainer box.

Figure 10:
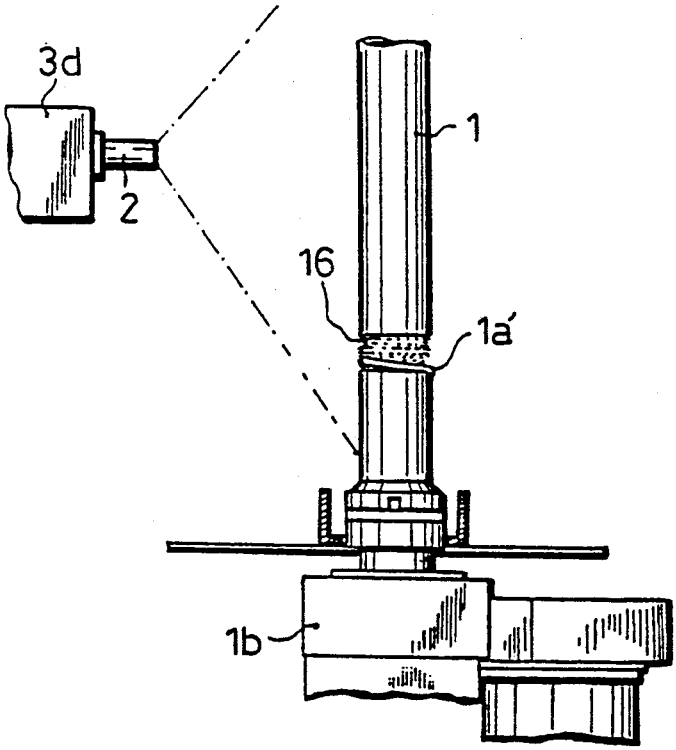
FIG. 10 is an enlarged side view showing the positional relationship between the nozzle and the bobbin at the end of the suction operation.

As mentioned above, the suction operation is carried out at the retracted position 3d (see FIG. 6) corresponding to the substantially intermediate vertical position of the bobbin 1. However, there is a case that a starting end 1a' of the residual roving is still left at the roving wind assisting cloth 16 even after the end of the suction operation by the suction nozzle 2 as shown in FIG. 10 (enlarged view of a part of FIG. 6). The end of the suction operation is determined when pass of a fiber of the roving through the duct 4 or a fiber exhausting passage provided downstream of the duct 4 has not been detected by a fiber detection device (not shown).

Figure 11:
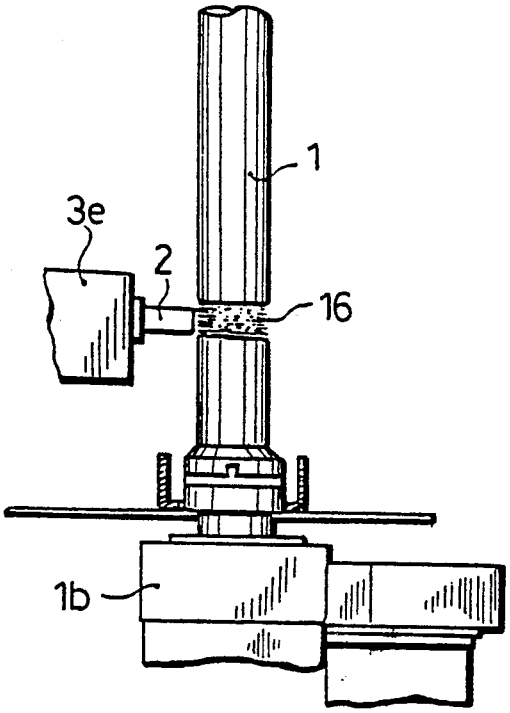
FIG. 11 is a view similar to FIG. 10, showing the operation of sucking a starting end of the roving left on the assisting cloth after the end of the suction operation.

According to the present invention, after the end of the suction operation, the retainer box 3 is lowered to a vertical position such that the nozzle 2 faces he roving wind assisting cloth 16 irrespective of the fact that the residual starting end 1a' is present of absent at the assisting cloth 16. Then, the retainer box 3 is advanced to a limit position 3e as shown in FIG. 11. The vertical position of the nozzle 2 corresponding to the vertical position of the assisting cloth 16 is detected by a position sensor provided on a locus of vertical movement of the duct 4, the lifting member 5 or the chains 6, and the driving motor 7 is stopped when the position sensor is operated.

The advance limit position of the retainer box 3 is maintained under the condition where the tip of the nozzle 2 is located close to or in slight contact with the assisting cloth 16. As previously mentioned, the projections formed on the assisting cloth 16 are inclined in the winding direction of the roving or erected radially, causing a tendency that the residual starting end 1a' is left on the assisting cloth 16 upon removing the residual roving. To eliminate this problem, the present invention is featured by the construction that the suction nozzle 2 is advanced to the assisting cloth 16 and that the bobbin 1 is rotated alternately in the forward direction and the reverse direction by the rotary driving device 1b. Accordingly, the starting end of the roving left on the assisting cloth 16 can be completely removed irrespective of the direction of the projections on the assisting cloth 16.

As described above, according to the present invention, the suction nozzle is moved to face the roving wind assisting cloth, so as to remove a starting end of the roving left on the assisting cloth after the end of the suction operation. Therefore, the starting end of the roving left on the assisting cloth can be completely removed.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A method for removing a residual roving from a rotatable roving bobbin and from a roving winding assisting member which assists a winding start of a roving around a blank bobbin by using a movable suction nozzle, comprising the steps of:

rotating the rotatable roving bobbin;

vertically moving said suction nozzle along said roving bobbin and then horizontally moving said suction nozzle so as to advance and retract said suction nozzle toward and away from said roving bobbin for permitting the suction nozzle to remove a residual roving from said roving bobbin by suction while said bobbin is rotating; and then positioning a tip of said suction nozzle at a vertical position corresponding to a height of said roving winding assisting member of said roving bobbin and a horizontal position close to said roving assisting member for removing a residual roving on said roving wind assisting member and then alternately rotating said roving bobbin in forward and reverse directions.

2. The method according to claim 1, wherein said step of vertically and horizontally moving said suction nozzle comprises:

maintaining a predetermined gap between the tip of said suction nozzle and the roving bobbin.

* * * * *